United States Patent [19]

Vanderford, Jr. et al.

[11] Patent Number: 4,828,293

[45] Date of Patent: May 9, 1989

[54] WELLHEAD SLIP AND SEAL ASSEMBLY

[75] Inventors: Delbert E. Vanderford, Jr., Cypress; Jerry D. Smith, Houston, both of Tex.

[73] Assignee: Cameron Iron Works USA, Inc., Houston, Tex.

[21] Appl. No.: 153,224

[22] Filed: Feb. 8, 1988

[51] Int. Cl.[4] ..... F16L 21/06

[52] U.S. Cl. ..... 285/147; 285/910

[58] Field of Search ..... 285/144, 145, 146, 147, 285/148, 910

[56] References Cited

U.S. PATENT DOCUMENTS

| | | | |
|---|---|---|---|
| 1,984,806 | 12/1934 | Pfefferle | 285/910 X |
| 3,038,745 | 6/1962 | Cooke | 285/148 |
| 3,095,627 | 7/1963 | Johnson | 285/146 X |
| 3,188,118 | 6/1965 | Jones | 285/147 X |
| 4,402,535 | 9/1983 | Bridges | 285/145 |

*Primary Examiner*—Dave W. Arola

*Attorney, Agent, or Firm*—Vinson & Elkins

[57] ABSTRACT

An improved wellhead slip and seal assembly including a slip assembly with slips supported in a slip bowl and with the seal assembly positioned above and interconnected to the slip assembly. The seal assembly includes a segmented retainer ring which is at least partially radially compressible and having inner and outer recesses in which resilient sealing rings are positioned and the retainer ring has an outer diameter at such recesses which is larger than the inner diameter of the housing in which it is to be positioned and includes an external tapered surface from said outer diameter to a smaller outer diameter therebelow which is smaller than the inner diameter of the housing so that the retainer ring is moved radially inwardly as it is moved into position within said wellhead housing. Means interconnects the slip bowl and the segmented retainer ring to assist in retaining the seal ring in its desired position until the assembly has been landed within the wellhead housing. The usual camming and limited relative axial movement connection is provided between the slips and the slip bowl and the slips include teeth on their internal surface which are suitable for the support of a string within the slip and sealing assembly.

9 Claims, 5 Drawing Sheets

WELLHEAD SLIP AND SEAL ASSEMBLY

BACKGROUND

The apparatus of the present invention is used to support and seal around a pipe or other string within a wellhead.

An example of a prior structure is illustrated in U.S. Pat. No. 2,920,909 to H. Allen. In this patent the pipe is supported by slips within a slip bowl which is supported on the tapered interior of the wellhead housing and upper slips are supported above a conical shaped seal ring so that the load of the supported pipe causes the seal ring to expand inward and outward into sealing engagement between the exterior of the pipe and the interior of the wellhead housing.

U.S. Pat. Nos. 3,311,168 and 4,390,186 disclose similar structure in which a landing ring supports inner and outer seal rings and the slip bowl engages the seal rings so that the pipe load of the slip bowl is transmitted at least in part through the seal rings.

U.S. Pat. No. 4,494,778 to C.W. Johnson discloses another similar structure in which the slip bowl is connected to a seal assembly ring above the slip bowl by cap screws so that the seal assembly is moved into the interior of the wellhead housing as the slip bowl is lowered therein. The seal assembly includes spreaders which are forced inwardly as the seal assembly is moved within the housing and this movement of the spreaders compresses the seal ring so that it is moved radially into sealing engagement between the interior of the wellhead housing and the exterior of the pipe string.

U.S. Pat. Nos. 2,824,757 and 3,287,035 are other structures for supporting and sealing a pipe string within a wellhead housing in which the slip bowl is connected to the seal loading so that the seal is set responsive to loading of the slip bowl by its support through its slips of the pipe string.

SUMMARY

The present invention relates to an improved wellhead slip and seal assembly including a slip assembly with slips supported in a slip bowl and with the seal assembly positioned above and interconnected to the slip assembly. The seal assembly includes a segmented retainer ring which is at least partially radially compressible and having inner and outer recesses in which resilient sealing rings are positioned and the retainer ring has an outer diameter at such recesses which is larger than the inner diameter of the housing in which it is to be positioned and includes an external tapered surface from said outer diameter to a smaller outer diameter therebelow which is smaller than the inner diameter of the housing so that the retainer ring is moved radially inwardly as it is moved into position within said wellhead housing. Means interconnects the slip bowl and the segmented retainer ring to assist in retaining the retainer ring in its desired position until the assembly has been landed within the wellhead housing. The usual camming and limited relative axial movement connection is provided between the slips and the slip bowl and the slips include teeth on their internal surface which are suitable for the support of a string within the slip and sealing assembly.

An object of the present invention is to provide an improved wellhead slip and sealing assembly in which the resilient seals are protected from being loaded by the load carried by the slip and bowl and are protected from extrusion due to high pressure loading.

Another object is to provide an improved slip and sealing assembly which is set by casing weight but thereafter does not support any casing weight.

BRIEF DESCRIPTION OF THE DRAWINGS

These and other objects and advantages are hereinafter set forth and explained with reference to the drawings wherein.

DESCRIPTION OF THE PREFERRED EMBODIMENTS

Figure 1:
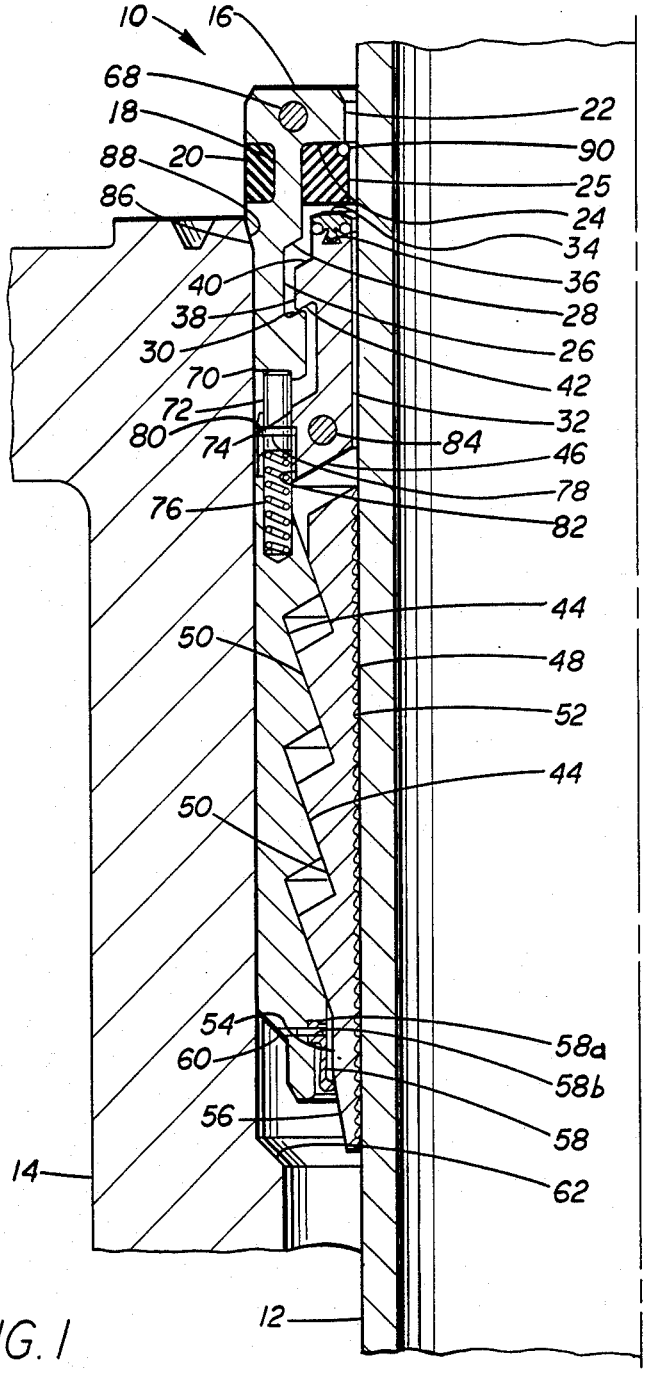
FIG. 1 is a partial vertical sectional view through the improved assembly of the present invention illustrating its position as it is entering within the wellhead housing.

Slip and seal assembly 10 as shown in FIG. 1 is the preferred form of the present invention and is illustrated in position assembled around string 12 and partially within wellhead housing 14. Slip and seal assembly 10 includes retainer ring 16 having outer groove 18 in which resilient sealing ring 20 is positioned, inner flange 22, the under surface of which forms shoulder 24 against which inner resilient sealing ring 25 is positioned and inner recess 26 having upper and lower end surfaces 28 and 30 which both taper upwardly and inwardly; slip bowl 32 having separate anti-extrusion device 34 positioned in its upper end within dovetail recess 36 as shown, outer projection 38 having upper and lower tapered surfaces 40 and 42 and, in assembled condition, projection 38 extends into seal ring recess 26, internal slip camming surfaces 44 on the lower portion of slip bowl 32 and an intermediate offset portion 46 extending between the upper portion to the lower portion of slip bowl 32; and slips 48 positioned within the lower portion of slip bowl 32 and having external camming surfaces 50 mating and in engagement with the internal camming surfaces 44 on slip bowl 32 and internal gripping teeth 52. The lower outer portion of each of slips 48 below camming surfaces 44 includes cylindrical surface 54 and low angle setting surface 56. Resilient fingers 58 supported from the lower portion of slip bowl 32 engage low angle setting surface 56 on slips 48 to urge it inwardly and to create the initial engagement of gripping slips 48 with the exterior of string 12. After the slip and seal assembly 10 has been assembled around string 12 and the slips 48 released from their inactive position slips 48 move downward and by coming into engagement with fingers 58 are brought into engagement with string 12. Thereafter any downward movement by string 12 with reference to slip bowl 32 results in relative downward movement of slips 48 on bowl camming surfaces 44 to tighten the engagement of slips 48 with string 12 and to allow bowl 32 to assume some of the load of supporting string. Fingers 58 are integral with ring **58*a* which is secured within the lower portion of slip bowl 32 by press fit pins 58*b* as shown. It is preferred that fingers 58 be individual resilient elements engaging surface 56 but if desired they could be a single skirt engaging all of the setting surfaces 56 of the slips 48 to ensure that the initial setting of the slips 48 against the exterior of string 12 is provided with the initial downward movement of the string within assembly 10**.

When it is desired that slip and seal assembly 10 support the weight of string 12, the weight of string 12 is gradually released to be exerted on slips 48 and with slip and seal assembly 10 being seated with seating shoulder 60 on the lower outer end of slip bowl 32 being in engagement with housing seat 62 the entire weight of string 12 may be released to assembly 10 and it will be transmitted by slips 48 and slip bowl 32 to housing seat 62.

Figure 2:
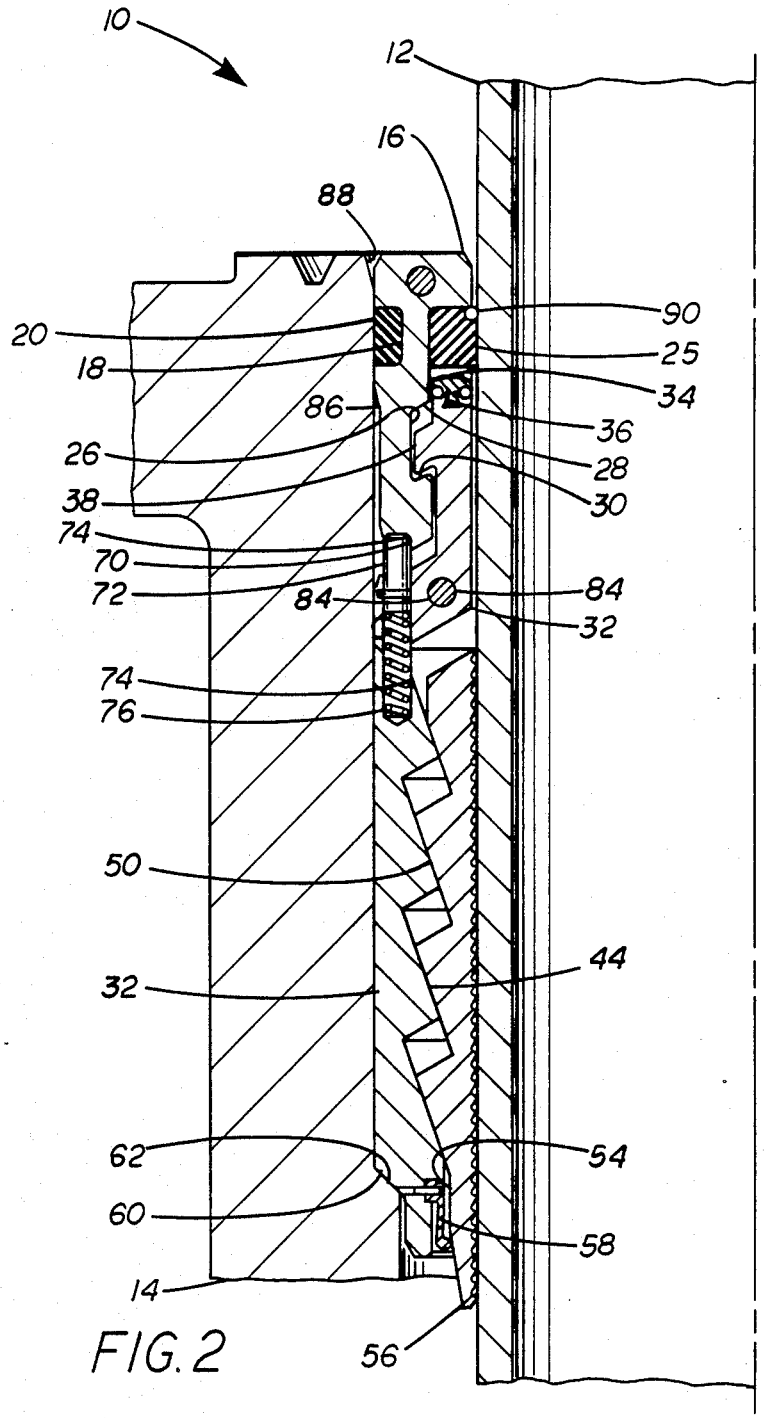
FIG. 2 is another similar sectional view of the assembly shown in FIG. 1 but illustrating it in seated and sealing position.
Figure 4:
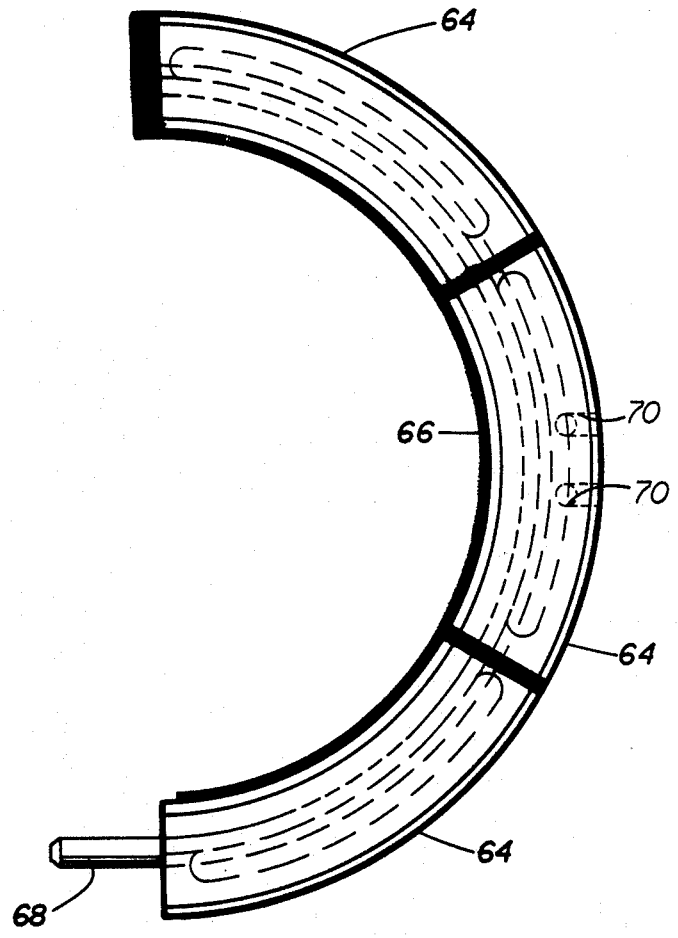
FIG. 4 is a plan view of half of the sealing assembly.

As shown in FIG. 4, retainer ring 16 includes three arcuate segments 64 which are embedded in an elastomeric material to form half ring 66 and have pin 68 extending from one end of half ring 66 with an opening on the other end to receive the pin 68 from the other half ring 66 with which it mates. Prior to molding, segments 64 are spaced outward and located on a larger diameter not to exceed the maximum diameter allowed under API specification 6A. Sufficient elastomeric material is used to ensure positive sealing between the arcuate segments 64 and between the two half rings 66. It is preferred that protruding elastomer from the face of one seal half ring 66 fits into a mating recess in the other seal half ring 66 similar to a tongue and groove interengagement. Additionally each half ring 66 includes two opening 70 extending upwardly therein from their lower side to receive locating pins 72 which are positioned in bores 74 in offset portion 46 of slip bowl 32 as best shown in FIGS. 1 and 2. Pins 72 are biased upwardly toward openings 70 by springs 76 and pins 78 are secured to pins 72 to limit their upward travel by the engagement of pins 78 with shoulders 80 at the upper end of counterbores 82 in which pins 72 and springs 76 are positioned.

Slip bowl 32 is also made in two half sections with end pins 84 providing interengagement and with suitable connecting means (not shown), such as bolts or other suitable latching mechanism or connecting means.

As shown in FIG. 2, the movement of assembly 10 downward within wellhead housing 14 continues until seating shoulder 60 on the lower portion of slip bowl 32 comes into engagement with housing seat 62. During this movement the exterior tapered surface 86 of retainer ring 16 engages tapered surface 88 within the upper portion of wellhead housing 14 and cams retainer ring 16 inwardly to move inner resilient sealing ring 25 into sealing engagement with the exterior of string 12. Also, outer resilient sealing ring 20 is sufficiently large that it projects slightly beyond the outer diameter of retainer ring 16 to ensure sealing against the inner surface of housing 14.

Sealing ring 25 includes a resilient material with anti-extrusion device 90 which may be a rope embedded within the inner upper corner of ring 25. Device 90 assists in bridging any gap between the interior of retainer ring 16 and the exterior of string 12. Retainer ring 16 is designed to have an inner diameter sufficiently large to accommodate all variations in sizes of the string 12 which are the result of tolerances. Thus, when retainer ring 16 is cammed inwardly there will be a small gap between its inner surface and the exterior of the string in all cases. The variation of sizes of string 12 as a result of tolerance in the manufacture of any particular nominal size of such tubular members causes ring 16 to be slightly larger and thus it is believed that the addition of the device 90 assists in the retention of the elastomeric material below shoulder 24 even when exposed to pressure. Anti-extrusion device 34 is composed of ropes bonded to an elastomer and held in place within dovetail recess 36 on the upper end of slip bowl 32. It should be mentioned that sealing rings 20 and 25 and anti-extrusion devices 90 and 34 are in half sections unless assembly 10 can be installed over the upper end of string 12. For all other applications both slip bowl 32 and all of its components and retainer ring 16 and all of its components must be split and installed in sections around string 12.

Pins 72 function to interconnect retainer ring 16 to slip bowl 32, to orient the split in ring 16 with respect to the split in slip bowl 32, to act as top latching arrangement for slip bowl halves, to act as stops to prevent outward movement of seal ring halves 66, to allow freedom of inward movement of retainer ring 16 during seal energization, and to ensure concentricity of retainer ring 16 with respect to slip bowl 32 to ease installation through a blowout preventer stack and into mating preparation.

Figure 3:
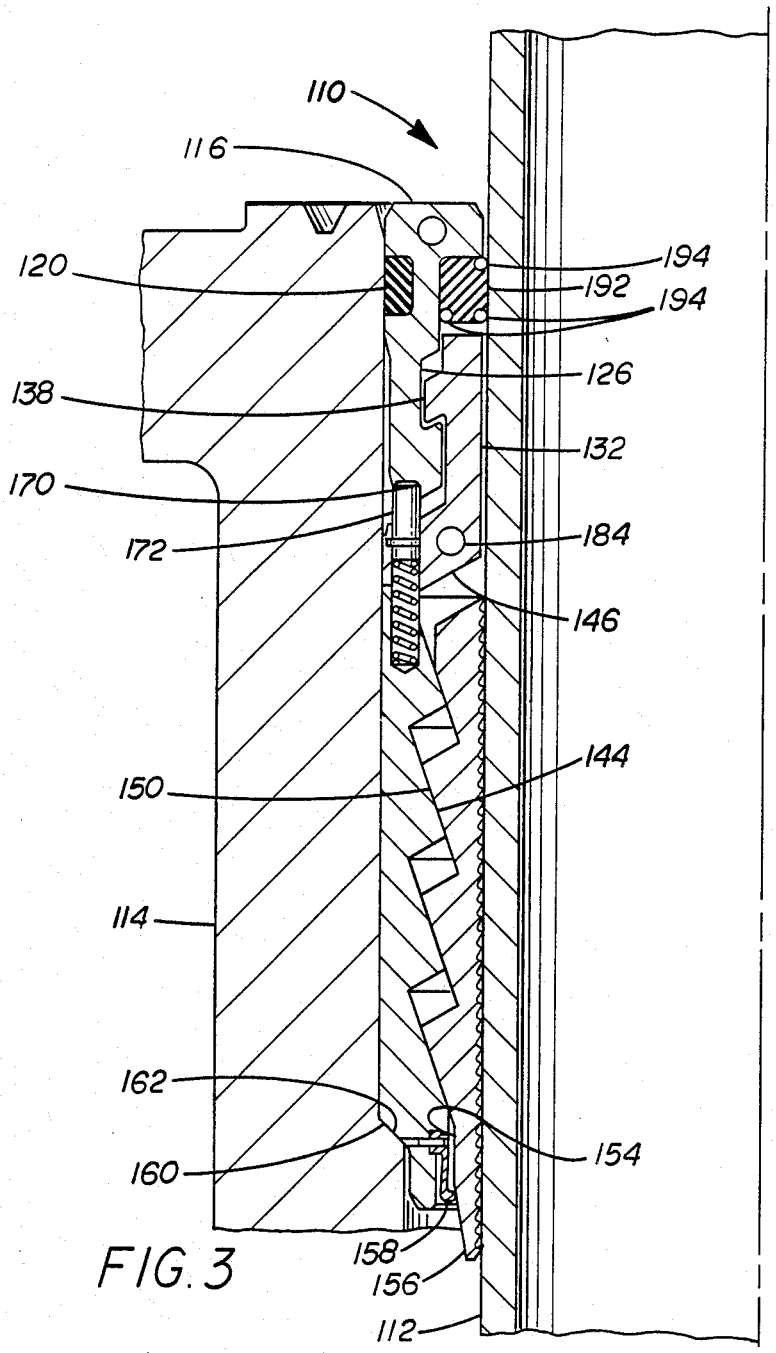
FIG. 3 is another similar sectional view of modified assembly of the present invention in its seated and sealing position.

Slip and seal assembly 110, shown in FIG. 3, is substantially identical with seal assembly 10 and components which are identical have the same numbers with the prefix "1" in their designations. Seal assembly 110 includes sealing ring 92 which includes anti-extrusion devices 94, such as ropes or other suitable devices, embedded in the upper and lower inner corners and in the outer lower corner as shown. Also, assembly 110 does not include separate anti-extrusion device 34. With this configuration, sealing ring 92 is reinforced at the three corners and this assists in the retention of its shape when it is exposed to pressure.

Figure 5:
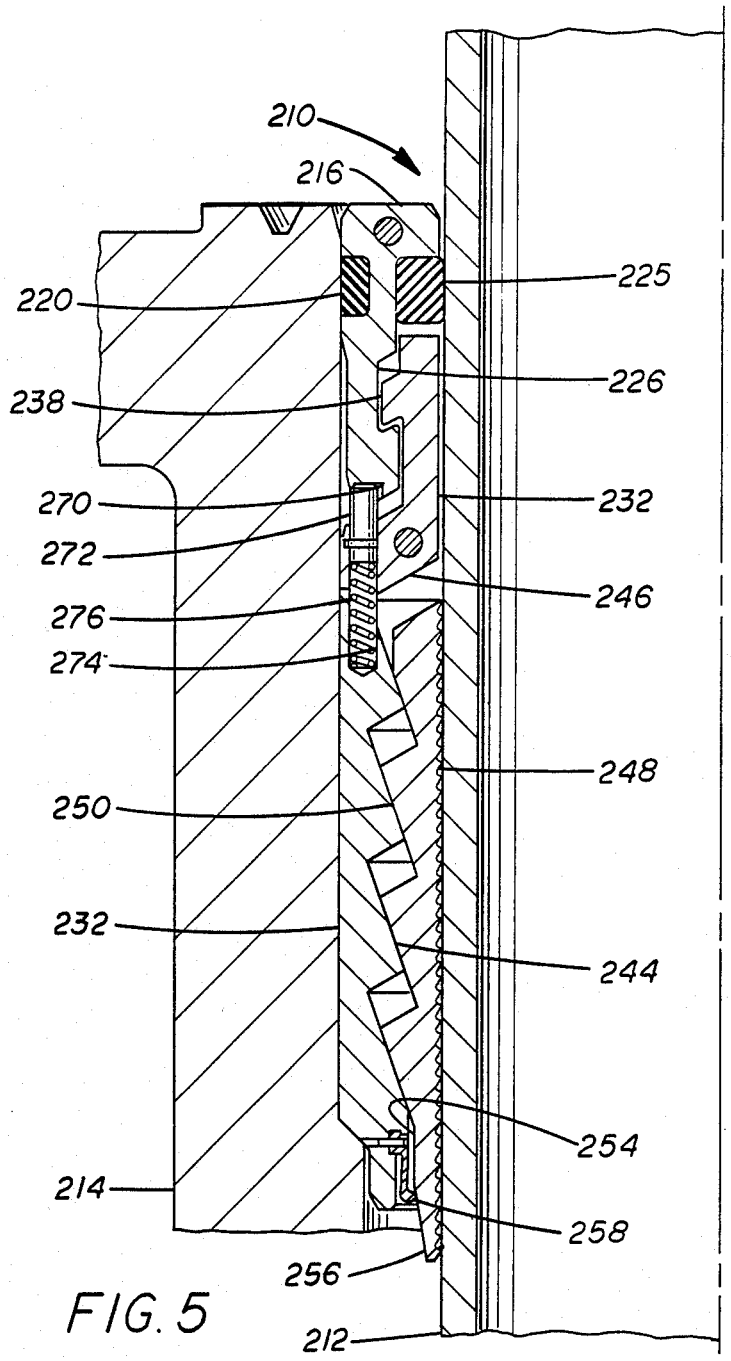
FIG. 5 is another partial sectional view of another modified assembly of the present invention in its seated and sealing position.

While both assembly 10 and 110 have been shown with the anti-extrusion devices, it is considered that no such devices may be needed in all cases. Slip and seal assembly 210, shown in FIG. 5, illustrates such structure and is the second modification of the preferred form of the invention. In FIG. 5 assembly 210 includes all of the components of assembly 10 with the same part numbers except that the components in FIG. 5 include the prefix number "2" in their designation. Assembly 210 is exactly like assemblies 10 and 110 except that it does not include any anti-extrusion device for the protection of its sealing ring 225.

Slip and seal assembly 10, 110 and 210 are installed in the following steps with reference being made only to the components of assembly 10. After string 12 is supported in tension as desired, the halves of slip bowl 32 are installed around string 12 with the pins 84 positioned within the recesses in the other of the bowl halves and the assembled slip bowl 32 is then temporarily supported above the blowout preventer stack or the bowl preparation using suitable material. The bottom of slip bowl 32 at the splits is secured using bolts or other suitable latching mechanism. Halves 66 of seal assembly are installed around string 12 above slip bowl 32 with pins 68 positioned within the mating holes in the other half 66. The split of retainer ring 16 is oriented to be ninety degrees from the split of slip bowl 32. Pins 72 are depressed until sufficient vertical space if provided to allow outer projection 38 on slip bowl 32 to enter within recess 26 in retainer ring 16. This also positions the lower portion of retainer ring 16 within the recess formed below projection 38 and the offset portion 46 of slip bowl 32. Pins 72 should be positioned within openings 70 in ring 16. Assembly 10 should be relieved of its temporary support and with slips 48 free to move relative to bowl 32, assembly 10 is lowered until tapered surface 86 on retainer ring 16 engages tapered surface 88 on the upper interior of housing 14. The sealing portion of slip and seal assembly 10 is energized by reducing tension in string 12. As slips 48 grip string 12, assembly 10 is lowered within housing 14 and retainer ring 16 is forced radially inward against string 12 by the tapers on surfaces 86 and 88. The energization of sealing is complete immediately before the landing of seating shoulder 60 on housing seat 62. When testing from above, sealing will be enhanced as a result of a pressure multiplier effect. Pressure containment from the bottom is a function of inherent elastomer compression resulting from the initial radial energization. Sealing is accomplished at the splits due to circumferential force created during energization of the elastomer.

It should be noted that once the improved slip and seal assembly of the present invention is installed within a wellhead housing and in supporting and sealing relationship around a string, the support of the string is taken up by the slip assembly and transmitted by the slips through the slip bowl directly to the housing seat. There is no compression of any of the seals as a result of the string loading of the slip assembly. The radial energization of the seal assembly results from the shape of the seal ring and does not rely on having oversized seal ring to ensure the radial compression of the resilient inner seal during energization. Once installed the engagement of projection 38 against the end surface 30 of seal ring recess 26 ensures that retainer ring 16 moves into housing 14 with the downward movement of slip bowl 32 during energization.

What is claimed is:

1. A slip and seal assembly for supporting and sealing a string within a wellhead housing comprising a retainer ring having an outer recess and an inner flange forming a downwardly facing shoulder thereunder, a outer surface below said outer recess tapering downwardly and inwardly and an inner recess having upper and lower end surfaces tapering inwardly and upwardly, an outer resilient seal ring positioned within said outer recess, an inner resilient seal ring positioned in engagement with said flange shoulder, said retainer ring being capable of moving radially inward, a slip bowl having a lower inner camming surface and an upper outer projection for engaging within and slidable in said inner recess of said retainer ring and, said upper outer projection being at a level above said lower inner camming surface, a plurality of slips positioned within said slip bowl and each of said slips having internal gripping teeth, an upper external camming surface in engagement with said slip bowl camming surface and a lower shallow taper external camming surface at a level below said upper external camming surface, and loading means carried by said slip bowl below said lower camming surface for engaging said lower shallow taper camming surface on said slips to ensure initial engagement of said slips with the string, downward movement of the string within the assembly moving the assembly downward within the wellhead housing moving the outer tapered surface of said retainer ring into engagement with the housing to cam the retainer ring inwardly and bring the resilient seal rings into sealing engagement with said string and said housing prior to the seating engagement of the assembly within the housing and also to move said bowl camming surface relative to said slips to set said slip teeth into the string.

2. A slip and seal assembly according to claim 1 wherein said loading means includes at least one finger supported from the lower end of said slip bowl engaging the shallow taper camming surface and resiliently urging the lower portion of said slip into initial gripping engagement with the string.

3. A slip and seal assembly according to claim 1 including anti-extrusion means associated with said inner resilient sealing ring positioned under said flange shoulder.

4. A slip and seal assembly according to claim 3 wherein said anti-extrusion means includes an anti-extrusion device embedded in the upper inner corner of said sealing ring.

5. A slip and seal assembly according to claim 3 wherein said anti-extrusion means includes anti-extrusion devices embedded in the inner corners of said sealing ring.

6. A slip and seal assembly according to claim 4 including an anti-extrusion device mounted on the upper end of said slip bowl and positioned below the lower surface of said inner resilient sealing ring.

7. A slip and seal assembly according to claim 1 including means interconnecting the lower end of said retainer ring to said slip bowl to allow radial energization movement of said retainer ring with respect to said slip bowl while providing circumferential orientation of said retainer ring and said slip bowl and limiting the outward movement of said retainer ring to ensure its entry in the housing bore.

8. A slip and seal assembly according to claim 7 wherein said interconnecting means includes radial slots in said retainer ring, and pins positioned within said slip bowl and extending upwardly into said radial slots.

9. A slip and seal assembly comprising a slip assembly with slips supported in a slip bowl, and a seal assembly positioned above and interconnected to the slip assembly, said seal assembly includes a segmented retainer ring which is at least partially radially compressible and having inner and outer recesses in which resilient sealing rings are positioned, said retainer ring also having an outer diameter adjacent the outer recess which is larger than the inner diameter of the housing in which it is to be positioned and includes an external tapered surface from said outer diameter to a smaller outer diameter therebelow which is smaller than the inner diameter of the housing so that the retainer ring is moved inwardly or compressed as it is moved into position within said wellhead housing, and means interconnecting the slip bowl and the segmented retainer ring to assist in retaining the retainer ring in its desired position until the assembly has been landed within the wellhead housing, each of said slips and said bowl including mating camming surfaces with teeth being included on the interior of said slips and initial setting means on said bowl below said mating camming surfaces for setting the lower teeth of said slips into gripping engagement with a string extending therethrough so that downward movement of a string moves said slips and slip bowl downwardly and said seal assembly downwardly into the wellhead housing to move said seal assembly radially inward to set the resilient inner sealing ring and also to move said bowl camming surface relative to said slips to set said slip teeth into the string.

* * * * *